US006465407B2

(12) United States Patent
Hayashi et al.

(10) Patent No.: US 6,465,407 B2
(45) **Date of Patent: *Oct. 15, 2002**

(54) SHEETLIKE ARTICLE FOR WASHING

(75) Inventors: Hiromitsu Hayashi; Hiroyuki Saijo; Hirohiko Hanada; Toshiki Nishi; Shinji Nakao, all of Wakayama (JP)

(73) Assignee: Kao Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/355,114

(22) PCT Filed: Dec. 26, 1997

(86) PCT No.: PCT/JP97/04870

§ 371 (c)(1),
(2), (4) Date: Jul. 23, 1999

(87) PCT Pub. No.: WO98/32835

PCT Pub. Date: Jul. 30, 1998

(65) Prior Publication Data

US 2002/0013251 A1 Jan. 31, 2002

(30) Foreign Application Priority Data

Jan. 23, 1997 (JP) ..... 9-010168

(51) Int. Cl.[7] ..... C11D 17/04

(52) U.S. Cl. ..... 510/295; 510/296; 510/438; 510/439

(58) Field of Search ..... 510/295, 296, 510/438, 439

(56) References Cited

U.S. PATENT DOCUMENTS

| | | | | | |
|---|---|---|---|---|---|
| 3,836,044 | A | * | 9/1974 | Tilp et al. | 221/55 |
| 4,025,444 | A | * | 5/1977 | Murphy et al. | 252/8.8 |
| 4,170,565 | A | | 10/1979 | Flesher et al. | |
| 4,610,799 | A | * | 9/1986 | Wilsberg et al. | 252/186.38 |
| 4,654,395 | A | * | 3/1987 | Schulz et al. | 526/318.42 |
| 4,743,394 | A | | 5/1988 | Kaufmann et al. | |
| 4,806,261 | A | * | 2/1989 | Ciallella et al. | 510/296 |
| 4,885,105 | A | | 12/1989 | Yang et al. | |
| 4,938,888 | A | * | 7/1990 | Kiefer et al. | 510/295 |
| 5,202,045 | A | | 4/1993 | Karpusiewicz et al. | |
| 5,208,089 | A | * | 5/1993 | Norris | 510/520 |
| 6,187,739 | B1 | * | 2/2001 | Merz et al. | 510/371 |

FOREIGN PATENT DOCUMENTS

| | | | | |
|---|---|---|---|---|
| EP | 0158464 | A1 | * | 10/1985 |
| JP | 61 12796 | A | | 1/1986 |
| JP | 63-8496 | A | | 1/1988 |
| JP | 63-12466 | A | | 1/1988 |
| JP | 63008496 | | * | 1/1988 |
| JP | 2228398 | A | | 9/1990 |
| JP | 04202600 | A2 | * | 7/1992 |
| JP | 10072599 | A | | 3/1998 |
| WO | WO-97/11150 | A1 | * | 3/1997 |

* cited by examiner

*Primary Examiner*—Lorna M. Douyon
(74) *Attorney, Agent, or Firm*—Birch, Stewart, Kolasch & Birch, LLP

(57) ABSTRACT

To provide a sheetlike article for laundry which is freed from the scattering or leak of the contents, facilitates arbitrary dispensing and exhibits excellent detergency even when used alone, sheetlike water-soluble substrates are arranged on both surfaces of a thin layer made of a doughy non-phosphate detergent composition which contains nonionic surfactant(s), alkaline agent(s) and sequestering agent(s) and has a penetration hardness at 25° C. of from 0.1 to 10 kg/cm$^2$.

7 Claims, 2 Drawing Sheets

SHEETLIKE ARTICLE FOR WASHING

This application is the national phase under 35 U.S.C. §371 of PCT International Application No. PCT/JP97/04870 which has an International filing date of Dec. 26, 1997, which designated the United States of America.

TECHNICAL FIELD

This invention relates to articles for laundry which facilitate arbitrary dispensing and can be conveniently used in practice with considerably relieved scattering or leak of the contents. More particularly, it relates to sheetlike detergent compositions for clothes.

BACKGROUND ART

Conventional powdery or granular detergents suffer from the problem of scattering. As modes for effectively solving this problem of scattering, there have been proposed one-pack type detergents (unit packed detergents) and sheetlike detergents composed of a water-soluble or water-insoluble film or nonwoven fabric impregnated with detergent components (JP-A2-228398, GB-B 2084176, etc.). In the latter mode, however, the detergent components are exposed on the surface and adhere to hands or containers. When a water-insoluble film or nonwoven fabric is used as the substrate to be impregnated, it should be disposed after using, thus resulting in poor handling properties. In this case, moreover, there arises another problem that the insoluble fiber would partly fall out from the substrate in the course of stirring in a washing machine and, after drying, remain on the surface of clothes. This trouble is serious particularly in the case of dark clothes, since the fiber residues on the surface of such clothes are highly conspicuous.

As an example of articles for laundry with the use of a water-insoluble substrate other than those of the impregnation type, U.S. Pat. No. 4,170,565 discloses a product composed of an active detergent sandwiched between nonwoven fabrics having a specific air permeability. In this patent, however, use is made of a tripolyphosphate as a builder in a builder-rich detergent for clothes and, moreover, the detergent has a high moisture content. As you know well, use of phosphate-containing detergents for clothes should be minimized, since they bring about a problem of eutrophication. However, a composition containing a tripolyphosphate as a builder and water each in an amount of 15% or more has a great advantage which cannot be achieved by any other builders. That is to say, such a composition is excellent in transportation properties of the active detergent raw material at a definite viscosity. When the tripolyphosphate is substituted merely by, for example, zeolite and a sufficient viscosity is imparted to the detergent raw material so as to form the sandwich structure, the transportation efficiency of the active detergent with a pump, etc. is seriously lowered. As a result, the coating onto the substrate or the processing of the active detergent into a sheet can be carried out only at an extremely low efficiency. Namely, it is highly difficult to produce phosphate-free articles according to the patent cited above. When a water-soluble sheet is used as a substitute for the water-insoluble nonwoven fabric with poor handling properties employed in this patent, it is needless to say that the moisture content should be largely reduced. In this case, therefore, a phosphate-free sheetlike detergent causing no residue can be hardly obtained.

U.S. Pat. No. 5,202,045 proposes another mode wherein an active detergent component and/or an active bleaching agent are packed into two parts of an S-shaped water-soluble nonwoven fabric. In this case, use is made of a builder-rich composition containing a tripolyphosphate and water each in an amount of 15% or more similar to the mode of U.S. Pat. No. 4,170,565 as stated above. That is to say, this patent discloses in practice no technique for providing detergents for clothes containing builders: in particular, zeolite; usable as a substitute for phosphates and having a low moisture content.

As a mode for solving one of these problems encountering in the prior art, JP-A 61-12796 proposes an article obtained by processing a non-powdery detergent composition containing a nonionic surfactant into a sheet and coating both surfaces thereof with a water-soluble film, etc. However, this patent discloses exclusively examples wherein water-soluble polymer compounds are mixed with bleaching agents and surfactants and the resultant mixtures are heat-molded into sheets. Therefore, the detergent components are partly exposed on the surfaces of the thus obtained sheets and adhere to hands or containers, similar to the articles of the impregnation type as described above. That is to say, this patent discloses no particular and effective technique for processing a detergent composition into a sheet and coating both surfaces of the sheet with a water-soluble film, etc.

Moreover, the compositions disclosed in the above patent are to be used as detergents on the assumption that other detergents are used together. Therefore, these compositions contain neither alkaline agents nor sequestering agents which are fundamental components of detergents for clothes. When such a composition is used alone, it is therefore impossible to achieve any sufficient detergency. Moreover, it is unfavorable from the viewpoints of convenience and economics to use them together with other detergents. It is also unfavorable to prepare these compositions by adding water-soluble polymer compounds such as polyvinyl alcohol. This is because, in this case, these water-soluble polymers come into contact with the alkaline agents at enlarged area and thus frequently undergo hydrolysis.

In most of detergents for clothes, surfactants, sequestering agents and alkaline agents are used in large amounts as fundamental components. It is very difficult to obtain a sandwich-type composition which is capable of carrying these active detergent components in large amounts.

Under these circumstances, it has been urgently required to develop a sheetlike detergent which contains a builder as a substitute for phosphates in a sufficient amount for achieving excellent detergency even though employed alone, is excellent in convenience and can carry relatively large amounts of active detergent components so as to prevent the contents from the scattering or leak. In the field of fiber softeners and bleaching agents, on the other hand, it has been also required to develop a sheetlike article for laundry which is freed from the scattering of powders, has a high compatibility with the environment, contains a fiber softening component or an active bleaching agent in a sufficient amount, has a high flexibility and can be completely dissolved in the step of laundry.

DISCLOSURE OF THE INVENTION

The present inventors have conducted extensive studies to obtain articles for laundry which are excellent in convenience and freed from the scattering or leak of the contents. As a result, they have found out that a highly thin sheetlike article, compared with the conventional detergents of the one-pack type, etc., can be obtained by providing a means for sustaining a thin layer containing a powdery or granular composition or a thin layer containing a dough-like composition and that the thus obtained article has an improved durability when brought into contact with wet hands, suffers from no leak of the contents due to broken, thus facilitates arbitrary dispensing, and is highly convenient in using with no need for removal of the sheet after washing. The present invention has been completed based on this finding.

Accordingly, the present invention provides a sheetlike article for laundry composed of a thin layer containing one or more compositions selected from among detergent compositions for clothes, fiber softener compositions and bleaching compositions and a means for sustaining this thin layer.

Figure 1:
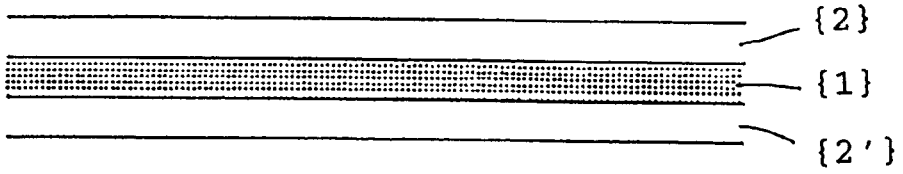
FIG. 1 schematically shows an example of the sheetlike article for laundry according to the present invention.
Figure 2:
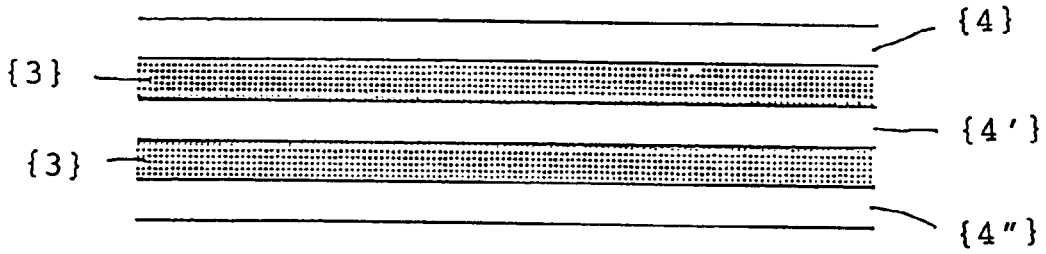
FIG. 2 schematically shows another example thereof.

In the sheetlike article for laundry according to the present invention which has a thin layer containing a composition and a means for sustaining this thin layer, the thin layer may be formed either continuously or discontinuously. Also, the means for sustaining may be arranged either outside or inside the thin layer. FIG. I shows an example of the sheetlike article for laundry according to the present invention. In FIG. 1, {1} represents a thin layer containing a composition while {2} and {2'} represent each a means for sustaining. In this case, use is made as the sustaining means of water-soluble sheets arranged on both surfaces of the thin layer. In FIG. 2, {3} represents a thin layer containing a detergent composition while {4}, {4'} and {4"} represent each a sheet-like water-soluble substrate (water-soluble sheet).

In the present invention, a means for sustaining a thin layer involves a mean which contributes to the sustenance of the thin layer by lowering the stickiness of the thin layer when it comes into contact with a substance (another thin layer, consumer, etc.) so as to relieve the damages caused by the contact, and one which prevents a powder or grains contained in the thin layer from scattering. Such a means may have additional functions too. It is appropriate in the present invention to use water-soluble sheets as the means for sustaining.

Water-soluble Sheet

First, water-soluble sheets preferably usable in the present invention will be illustrated. Test Examples I-1 to I-12 were carried out by using Test Method I.

Preferable examples of the water-soluble sheets to be used in the present invention include water-soluble films, nonwoven or woven fabrics made of water-soluble polymer fibers and laminate sheets comprising of water-soluble films with nonwoven or woven fabrics made of water-soluble polymer fibers. These water-soluble sheets are made of water-soluble polymers which are exemplified by polyvinyl alcohol, polyvinylpyrrolidone, pullulan, polyacrylamide, polyacrylic acid, polymethacrylic acid, polyitaconic acid, polyethylene oxide, polyvinylmethylene ether, xanthane gum, cyamoposis gum, collagen, carboxymethylcellulose, hydroxypropylcellulose and hydroxyethylcellulose. Among all, it is preferable to use therefor polyvinyl alcohol optionally modified with maleic acid or itaconic acid.

Among these water-soluble sheets, examples of water-soluble fabrics and nonwoven fabrics include nonwoven fabrics made of water-soluble polyvinyl alcohol fibers disclosed in JP-A 8-127919, JP-A 8-3848, JP-A 5-321105, JP-A 7-42019, JP-A 3-86530, JP-A 3-279410, JP-A 3-199408, JP-A 2-112406 and JP-A 61-75862; nonwoven fabrics obtained from fibers described in JP-A 1-229805, JP-A 64-33209, JP-A 3-199408, JP-A 2-112406, JP-A 3-27112 and JP-A 56-306; and supporting fabrics and nonwoven fabrics described in JP-A 61-75862, JP-A 60-162850, JP-A 3-25539 and JP-A 58-98464. Examples of the woven fabrics are those obtained by using various water-soluble polymer fibers as cited above. The water-soluble polymer fibers constituting these nonwoven fabrics or fabrics have preferably a diameter of 5 to 200 $\mu$m, still preferably 5 to 50 $\mu$m.

Examples of the water-soluble films include those described in U.S. Pat. Nos. 3,186,869, 3,198,740, 3,280,037, 3322674, JP-U 48-33837, JP-U 48-88343, JP-U 50-140958, JP-U 51-150, JP-U 52-77961, JP-U 55-151853, JP-U 57-1851, JP-A 59-180085, JP-A 61-57700, JP-A 61-97348, JP-A 61-98752, JP-A 61-200146, JP-A 61-200147, JP-A 61-204254, JP-A 61-228057, JP-A 62-57492, JP-A 62-156112, JP-A 62-275145, JP-A 63-8496, JP-A 63-8497, JP-A 63-12466, JP-A 63-12467, JP-A 64-29408, JP-A 64-29438, JP-A 2-60906, JP-A 2-108534, JP-A 2-163149, JP-A 3-59059, JP-A 4-53900, JP-A 4-57989, JP-A 4-63899, JP-A 4-72180, JP-A 4-147000, JP-A 4-164998, JP-A 4-174792 and JP-A 4-202600. As the water-soluble sheets in the present invention, it is also possible to use laminate sheets comprising nonwoven or woven fabrics made of the water-soluble polymer fibers and water-soluble films as cited above. These laminate sheets can be obtained by putting a water-soluble film onto one surface of a nonwoven fabric, etc. followed by heat sealing adherence. Alternatively, a water-soluble polymer is applied (coated) on one surface of a nonwoven fabric, etc. and then a film is formed. When such a laminate sheet is used, it is preferable to bring a water-soluble film into contact with a composition layer and to arrange a nonwoven fabric, etc. outside.

Figure 3:
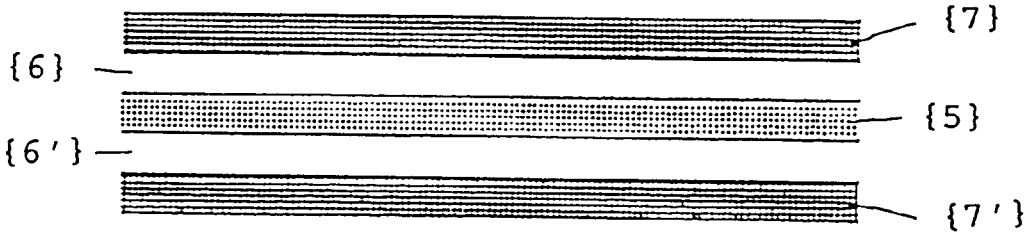
FIG. 3 schematically shows another example thereof.

FIG. 3 shows a sheetlike detergent according to the present invention with the use of a laminate sheet of the above type. The sheetlike detergent shown in FIG. 3 is composed of a thin layer containing a detergent composition and laminate sheets. Water-soluble films {6} and {6'} of the laminate sheets are arranged in contact with a thin layer {5} containing a detergent composition and water-soluble nonwoven fabrics {7} and {7'} are located outside the same.

Among the water-soluble sheets cited above, it is preferable to use nonwoven or woven fabrics made of water-soluble polymers from the viewpoint of easiness in tearing for arbitrary dispensing, etc. It is still preferable to use nonwoven or woven fabrics obtained with the use of fibers made of polyvinyl alcohol having been partly saponified, modified with carboxylic acids, modified with surfactants, etc. It is also preferable to use laminate sheets composed of these nonwoven or woven fabrics made of water-soluble polymer fibers and water-soluble films made of polyvinyl alcohol or polyvinyl alcohol modified with maleic acid or itaconic acid laminated inside.

It is preferable that the water-soluble sheets to be used in the present invention are soluble in water at 50° C. The term "soluble" as used herein means that 0.5 g of a water-soluble sheet is dissolved in 1 l of water at 50° C. within 10 minutes, preferably within 7 minutes and the resultant solution gives no residue after passing through a No. 8.6 sieve (Japanese pharmacopoeia: 2000 $\mu$m).

Composition

The sheetlike article for laundry of the present invention has a thin layer containing at least one composition selected from among detergent compositions for clothes, fiber softener compositions and bleaching compositions. Next, the compositions to be used in forming the thin layer will be illustrated.

Detergent Composition for Clothes

The detergent compositions for clothes usable in the present invention may comprise components commonly employed in this art such as anionic surfactants, nonionic surfactants, amphoteric surfactants, cationic surfactants, water-soluble inorganic salts, builders, chelating agents, antidepositioning agents, enzymes, sulfites, soil-releasing agents, dyetransfer inhibitors, fluorescent dyes, perfumes, antifoaming agents such as clay and silicone, percarbonates, perborates, bleaching activators, granulation aids such as high-molecular weight polyethylene glycol, etc., without restriction. When water-soluble sheets are arranged on both surfaces of the detergent composition layer, it is preferable that the detergent composition contains less than 15%, still preferably less than 9%, of moisture. In the case of powders or grains, the moisture content can be easily regulated by controlling the amount of water employed in the granulation step or the extent of drying. To produce a dough-like composition, on the other hand, it is preferable to use organic solvents, nonionic surfactants or a polyalkylene glycol having a molecular weight of 2000 or less, for example, polyethylene glycol or polypropylene glycol, to give a dough-like composition. As optional components, the detergent composition of the present invention preferably contains hydrotrops commonly employed in the art to elevate the solubility of high-density detergents, for example, urea, lower alkylbenzenesulfonic acids or lower alkylbenzenecarboxylic acids such as cumenesulfonic acid, toluenesulfonic acid, benzoates, etc.

A preferable mode of the sheetlike article for laundry according to the present invention comprises a thin layer made of a doughy composition formed of non-phosphate detergent composition comprising at least one nonionic surfactant, at least one alkaline agent and at least one sequestering agent, and the dough-like composition exhibits a penetration hardness at 25° C. of 0.1 to 10 kg/cm$^2$, and the above-mentioned means are water-soluble sheets arranged on both surfaces of the thin layer.

The detergent composition to be used in this sheetlike article for laundry is a doughy substance having a penetration hardness at 25° C. of 0.1 to 10 kg/cm$^2$, preferably 0.5 to 10 kg/cm$^2$ and still preferably 1 to 10 kg/cm$^2$. The term "dough" as used herein means a material obtained by kneading a powdery composition with a fluid such as a liquid, a paste or a gel. The fluid includes an agent which becomes fluid by heating or applying a force. Because of being dough, the detergent composition to be used in the present invention is freed from the scattering as observed in the case of powdery detergents. Moreover, the detergent composition has a low fluidity, i.e., a penetration hardness of 0.1 to 10 kg/cm$^2$. When the water-soluble sustainer such as a water-soluble sheet of the sheetlike article for laundry is broken due to, for example, contact with wet hands, or when the water-soluble sustainer is torn with hands for dispensing, there arises no leak of the contents. When the penetration hardness is less than 0.1 kg/cm$^2$, the detergent composition has a high fluidity because of the excessive softness. As a result, the detergent composition becomes difficult to obtain a sheetlike article or there arises the leak of the contents. When the penetration hardness is 10 kg/cm$^2$ or above, the detergent composition becomes brittle and thus can be hardly processed into a sheetlike article. The high brittleness also results in the leak of the contents.

A detergent composition to be used in a preferred embodiment of the present invention is a non-phosphate detergent composition which comprises at least one nonionic surfactant, at least one alkaline agent and at least one sequestering agent. Moreover, the detergent compositions usable in the present invention may comprise components commonly employed in the art such as anionic surfactants, amphoteric surfactants, cationic surfactants, water-soluble inorganic salts, builders, antidepositioning agents, enzymes, sulfites, soil-releasing agents, dyetransfer inhibitors, fluorescent dyes, perfumes, antifoaming agents such as clay and silicone, percarbonates, perborates, bleaching activators, granulation aids such as high-molecular weight polyethylene glycol, etc., without restriction. When water-soluble sheets are arranged on both surfaces of the doughy detergent composition layer, it is preferable that the detergent composition contains less than 10%, still preferably less than 5%, of moisture. To obtain a dough-like composition, it is preferable to use organic solvents, nonionic surfactants or polyalkylene glycols, for example, polyethylene glycol or polypropylene glycol, having a molecular weight of 2,000 or less to give a dough-like composition. As optional components, the detergent composition of the present invention preferably contains hydrotrops commonly employed in the art to elevate the solubility of high-density detergents, for example, urea, lower alkylbenzenesulfonic acids or lower alkylbenzenecarboxylic acids such as cumenesulfonic acid, toluenesulfonic acid and benzoates.

Examples of the nonionic surfactants usable in the detergent composition according to the present invention include polyoxyalkylene alkyl ethers, polyoxyalkylene alkylphenyl ethers, polyoxyethylene sorbitan fatty acid esters, polyoxyethylene sorbitol fatty acid esters, polyethylene glycol fatty acid esters, polyoxyethylene fatty acid alkyl esters, polyoxyethylene polyoxypropylene alkyl ethers, polyoxyethylene polyoxypropylene fatty acid alkyl esters, polyoxyethylene alkylamines, glycerol fatty acid esters, polyoxyethylene higher fatty acid esters, higher fatty acid alkanolamides, polyoxyethylene higher fatty acid alkanolamides, fatty acid polyhydric alcohol esters, sucrose fatty acid esters, alkylamine oxides, alkyl glycosides and alkyl glucosamides. Either one of these nonionic surfactants or a mixture thereof may be employed. In particular, it is preferable to use, as the nonionic surfactant, polyoxyalkylene alkyl ethers prepared by adding alkylene oxides such as ethylene oxide and propylene oxide to primary or secondary, linear or branched alcohols having 10 to 18 carbon atoms and regulating the HLB (calculated by Grrifin's method) to 10.5 to 15.0, preferably 11.0 to 14.5.

Further, it is appropriate to use a nonionic surfactant which is in the form of a liquid or a slurry at 25° C., i.e., which has a melting point not higher than 25° C., since the nonionic surfactant is excellent in detergency, foaming properties, defoaming properties and solubility.

In the present invention, the content of the nonionic surfactant in the detergent composition ranges form 5 to 50% by weight, preferably 10 to 30% by weight.

If necessary, the detergent composition may further contain other surfactants such as anionic surfactants, amphoteric surfactants and cationic surfactants. It is preferable to use anionic surfactants.

Preferable examples of the anionic surfactants include sulfates of primary or secondary, linear or branched alcohols having 10 to 18 carbon atoms, sulfates of ethoxylated alcohols having 8 to 20 carbon atoms, alkylbenzenesulfonates, paraffinsulfonates, α-olefinsulfonates, α-sulfofatty acids, α-sulfofatty acid alkyl ester salts and fatty acid salts. It is particularly preferable to use therefor linear alkylbenzenesulfonates having alkyl groups with 12 to 14 carbon atoms and alkylsulfates with 12 to 18 carbon atoms. As counter ions, it is preferable to use alkali metals, in particular, one or more members selected from among sodium, potassium and alkanolamines.

As the alkaline agents to be employed in the detergent composition of the present invention, use may be made of arbitrary ones commonly used in detergents for clothes. Examples thereof include sodium carbonate, potassium carbonate, sodium bicarbonate, potassium bicarbonate, sodium sulfite, potassium sulfite, sodium sesquicarbonate, amorphous silicates in accordance with JIS No. 1, No. 2 and crystalline silicates, etc. and alkalnolamines such as monoethanolamine and diethanolamine. Either one of these alkaline agents or a mixture thereof may be used. It is particularly preferable to use therefor sodium carbonate, potassium carbonate, amorphous silicates and crystalline silicates.

Now, the crystalline silicates will be described in detail. It is appropriate to use in the present invention crystalline silicates having the following composition.

$$x(M_2O)\cdot y(SiO_2)\cdot z(Me_mO_n)\cdot w(H_2O) \quad (I)$$

wherein M represents an element of the group Ia in the periodic table; Me represents an element or a combination of two or more elements selected from among those of the groups IIa, IIb, IIIa, IVa and VIII in the periodic table; y/x is from 0.5 to 2.6; z/x is from 0.01 to 1.0; w is from 0 to 20; and n/m is from 0.5 to 2.0.

In the above formula (I), it is preferable that y/x ranges from 0.5 to 2.6, preferably form 1.5 to 2.2. When y/x is less than 0.5, the crystalline silicate shows only an insufficient resistance to dissolution in water, which exhibits highly undesirable effects on the caking properties and solubility of the silicate per se and the storage stability of the detergent composition. When y/x exceeds 2.6, on the other hand, the silicate suffers from a decrease in alkalinity and thus becomes insufficient as an alkaline agent. In this case, moreover, the ion exchange capacity thereof is also deteriorated and thus the silicate becomes insufficient as an ion exchanger too. In the formula (I), z/x ranges from 0.01 to 0.9, preferably from 0.02 to 0.9. When z/x is less than 0.01, the silicate shows only an insufficient resistance to dissolution in water. When z/x exceeds 0.9, the ion exchange capacity thereof is deteriorated and thus the silicate becomes insufficient as an ion exchanger. The values x, y and z are not particularly restricted, so long as the ratios y/x and z/x satisfy the requirements as defined above.

JP-A 7-89712 discloses a process for producing the crystalline silicates represented by the formula (I). In general, these silicates can be obtained by crystallizing amorphous glassy sodium silicate by baking at 200 to 1,000° C.

$$M_2O\cdot x'(SiO_2)\cdot y'(H_2O) \quad (II)$$

wherein M represents an alkali metal: x' is from 1.5 to 2.6; and y' is from 0 to 20.

JP-A 60-227895 discloses a process for producing the crystalline silicates represented by the formula (I). In general, these silicates can be obtained by crystallizing amorphous glassy sodium silicate by baking at 200 to 1,000° C. Methods for synthesizing these silicates are described in detail in, for example, Phys. Chem. Glasses, 7, 127-138 (1966), and Z. Kristallogr., 129, 396-404 (1969). The crystalline silicates represented by the formula (II) are commercially available as powdery or granular products from, for example, Hoechst under a tradename "Na-SKS-6" ($\delta$-$Na_2Si_2O_5$). These crystalline silicates have ion exchange capacity of at least 100 $CaCO_3$ mg/g, preferably from 200 to 600 $CaCO_3$ mg/g, thus serving as one of sequestering agents employed in the present invention.

As stated above, the crystalline silicate has an alkalinity and an alkali-buffering effect as well as an ion exchange capacity. By appropriately controlling the content thereof, it is therefore possible to achieve a desired detergency of the sheetlike detergent.

The average grain diameter of the crystalline silicate preferably ranges from 0.1 to 100 $\mu$m, still preferably from 1 to 60 $\mu$m. When the average grain diameter thereof exceeds 100 $\mu$m, the expression of ion exchange might be retarded, thus deteriorating the detergency. When the average grain diameter thereof is less than 0.1 $\mu$m, on the other hand, an enlarged specific area results in elevated moisture absorption and $CO_2$ absorption, thus remarkably deteriorating the qualities of the detergent composition. The term "average grain diameter" as used herein means the median diameter in the grain size distribution.

A crystalline silicate having such average grain diameter and grain size distribution as defined above can be prepared by grinding with a mill such as a vibrating mill, a hammer mill, a bowl mill or a roller mill.

In the present invention, the content of the alkaline agent in the detergent composition ranges from 5 to 60% by weight, preferably from 10 to 50% by weight.

As the sequestering agent to be employed in the detergent composition of the present invention, use may be made of arbitrary ones commonly employed in detergents for clothes. Examples thereof include the above-mentioned crystalline silicates, crystalline aluminosilicates such as zeolite A, P and X, amorphous aluminosilicates, organic chelating agents such as polycarboxylates and aminopolyacetates, and carboxylic acid polymers. Either one of these sequestering agents or a mixture thereof may be used. Although the above-mentioned crystalline silicates serve as an alkaline agent and a chelating agent, it is desirable to use additional alkaline agent(s) or sequestering agent(s).

Amorphous aluminosilicates can be easily obtained by reference to JP-A 6-179899.

Examples of the carboxylic acid polymers include polyacrylic acid and its salts, polyitaconic acid and its salts, poly-$\alpha$-hydroxyacrylic acid and its salts, (meth)acrylic acid/maleic acid (anhydride) copolymers and salts thereof, and polyglyoxylates described in JP-A 54-52196.

Other examples of the carboxylic acid polymers include aminocarboxylic acid polymers such as polyaspartates.

In the present invention, the content of the sequestering agent ranges from 5 to 60% by weight, preferably from 10 to 50% by weight.

In addition to the components described above, the detergent composition may contain dissolution aids such as sodium sulfate, p-toluenesulfonic acid, xylenesulfonates, talc, fine silica powder and clay; organic builders such as polyethylene glycol, polyvinyl alcohol, polyvinylpyrrolidone and carboxymethylcellulose; bleaching agents; enzymes; bluing agents; fluorescent dyes; defoaming agents/foaming inhibitors and perfumes. In particular, it is preferable to use polyethylene glycol having a molecular weight of 200 to 30,000 so as to control the penetration hardness.

The bleaching agents are exemplified by sodium percarbonate, sodium perborate (preferably monohydrate) and sodium sulfate/hydrogen peroxide adduct. Among all, sodium percarbonate is preferable therefor. When used in the detergent, in particular, together with an aluminosilicate such as zeolite, it is preferable that sodium percarbonate is coated with sodium borate.

The detergent composition to be used in the present invention may contain 10% or less, preferably 5% or less and still preferably 2% or less, of moisture. When it contains more than 10% of moisture, the water-soluble substrate arranged on both surfaces of the thin layer comprising the detergent composition are partly dissolved and become sticky. As a result, there arise some problems such that the sheetlike detergent articles adhere to each other, or when stored at a low temperature in, for example, winter, the detergent composition becomes dry and brittle and thus the flexibility of the sheetlike articles cannot be sustained in practice.

The components constituting the detergent composition to be used in the present invention are classified into organic matters and inorganic ones. In the total organic matters, the mixing ratio of liquid components to solid ones at ordinary temperature ranges preferably from 10/1 to 1/10, still preferably from 10/2 to 2/10. When the content of the liquid components exceeds the level as defined above, it becomes necessary to use a large amount of inorganic compounds capable of absorbing liquids so as to prevent the liquid components from oozing out from the dough, which is undesirable from an economical viewpoint. On the other hand, it is also undesirable to use solid organic matters, in particular, surfactants in an amount exceeding the level as defined above, since the solubility of the composition is deteriorated in this case.

On the other hand, it is effective in maintaining the flexibility of a raw material to regulate the mixing ratio of inorganic compounds to organic compounds. The content of the inorganic compounds in the whole composition, i.e. involving organic and inorganic compounds, is preferably from 30 to 95%. When the content of the inorganic compounds is less than 30% the composition can be easily processed by, for example, coating. When such a composition is processed into a sheet sandwiched between two or more substrates, however, there arises an undesirable phenomenon, i.e., the sustained leakage of active detergent components through the substrates with the passage of time. This problem is remarkable particularly with the use of liquid organic matters. When the content of the inorganic compounds exceeds 95%, a homogeneous dough can be hardly obtained by stirring. When such a composition is processed into a sheet sandwiched between substrates, moreover, there arises an undesirable phenomenon, i.e., the leakage of active detergent components upon breakage.

Fiber Softener Compositions

As the fiber softener to be employed in the present invention, use may be made of publicly known softeners containing as a softening base quaternary ammonium salts. It is particularly appropriate to use quaternary ammonium salts of di(long chain alkyl) type optionally containing linkage groups in the alkyl such as —COO—, —OCO—, —NHCO— or —CONH—. As optional components, use may be also made of perfumes, coloring matters, silicone compounds, antibacterial agents, solvents, water-soluble salts, etc.

Bleaching Compositions

Although the bleaching agent to be used in the present invention is not particularly restricted, it is appropriate to use oxygen bleaching agents. The oxygen bleaching agents contain compounds having peroxides capable of generating hydrogen peroxide in water. Examples of these peroxides include sodium percarbonate, sodium tripolyphosphate/hydrogen peroxide adduct, sodium pyrophosphate/hydrogen peroxide adduct, urea/hydrogen peroxide adduct, $4NaSO_4.2H_2O_2.NaCl$, sodium perborate monohydrate, sodium perborate tetrahydrate, sodium persilicate, sodium peroxide and calcium peroxide. Among all, it is preferable to use sodium percarbonate, sodium perborate monohydrate or sodium perborate tetrahydrate. If necessary, the composition may contain, as bleaching activators, compounds having an appropriate leaving group, tetraacetylethylenediamine, acetoxybenzenesulfonates, organic peracid precursors described in JP-A 59-22999,JP-A 63-258447 and JP-A 6-316700 or metallic catalysts prepared by stabilizing transition metals with sequestering agents. Moreover, it may contain solubilizing agents such as p-toluenesulfonates, xylenesulfonates, alkenylsuccinates and urea; penetrants; suspending agents such as clay; abrasives; chelating agents; pigments; dyes; perfumes; etc.

Sheetlike Article for Laundry

The sheetlike article for laundry according to the present invention may be prepared by an arbitrary process without restriction. First, the dough-like composition can be prepared by using a stirrer appropriate for stirring highly viscous materials such as a universal stirrer and a kneader. When use is made of components frequently undergoing thermal denaturation such as enzymes or bleaching components, it is preferable to regulate the stirring temperature to 40° C. or below. The dough-like composition thus obtained is molded into a sheet and then water-soluble sheets each comprising of at least one layer are laminated onto both surfaces of the dough-like composition. Another method comprises feeding the dough-like composition between two or more water-soluble sheets transported under, for example, rotation with rollers and, at the same time, compression-molding with the above rollers or others. Another method comprises applying the dough-like composition onto a water-soluble sheet comprising of at least one layer and then laminating another water-soluble sheet comprising of at least one layer on the composition thus applied. Alternatively, it is also possible that a water-soluble nonwoven or woven fabric is impregnated with the dough-like composition so as to make the nonwoven or woven fabric to carry the composition followed by the arrangement of water-soluble substrates on both surfaces of the layer thus formed.

By taking convenience in using into consideration, it is preferable that the sheetlike article for laundry according to the present invention has a thickness of 0.1 to 5 mm. That is to say, a thickness of 5 mm or less makes it easy to tear the sheetlike article for laundry, while a thickness of 0.1 mm or more makes it possible to load a sufficient amount of the detergent composition. It is still preferable that the thickness thereof ranges from 0.25 to 3 mm.

The sheetlike article for laundry according to the present invention preferably has an area density of 0.005 to 1.0 $g/cm^2$. When the area density falls within the range specified above, a sufficient amount of the detergent composition can be loaded thereon and thus an excellent detergency can be obtained. It is still preferable that the area density ranges from 0.02 to 0.5 $g/cm^2$.

It is desirable that the sheetlike article for laundry of the present invention is freed from the scattering or flow-out of the contents, when it is torn in practical using. The "scatter or flow-out of the contents" can be easily examined by the following two methods.

In one of these methods, a sheetlike article for laundry is cut all around to give a piece of 5 cm×5 cm. Then a weight of 200 g is loaded thereon in such a manner that the weight is loaded all over the surface of the article. After allowing to stand horizontally at 25° C. under a relative humidity of 60% for 30 minutes, it is examined whether the contents (i.e., the detergent composition) flow from the sections or not. No flow-out means that the article can be conveniently used without staining hands or the surroundings.

Another method aims at measuring the amount of the composition flowing/leaking out from the innermost layer when the sheetlike article is torn. This method comprises partly cutting a sheetlike article into 10 cm×20 cm with marketed scissors at the center of the article in a room at 25° C. under a relative humidity of 60%, then fixing the uncut side of 5 mm with a clip, hanging the sheet with the cut sides downward for 30 minutes while pooling in a plastic tray the detergent flowing/leaking out from the sheet followed by weighing.

The detergent according to the present invention is a sheetlike article which is freed form the leak or flow-out of the contents when it is torn or during using. Accordingly, it can be loaded or employed in various modes which cannot be applied to the conventional powdery, tablet or one-pack type detergents for laundry, softeners or bleaching agents. For example, the sheetlike article for laundry can be perforated so as to facilitate tearing. It is also possible to improve the appearance of the article by printing figures or letters thereon. Also, directions and instructions for using can be printed thereon to make consumers attend. Although the process for the production of the composition layer makes it easily possible to form a continuous layer, it is also possible, as a matter of course, to form a discontinuous composition layer.

Figure 4:
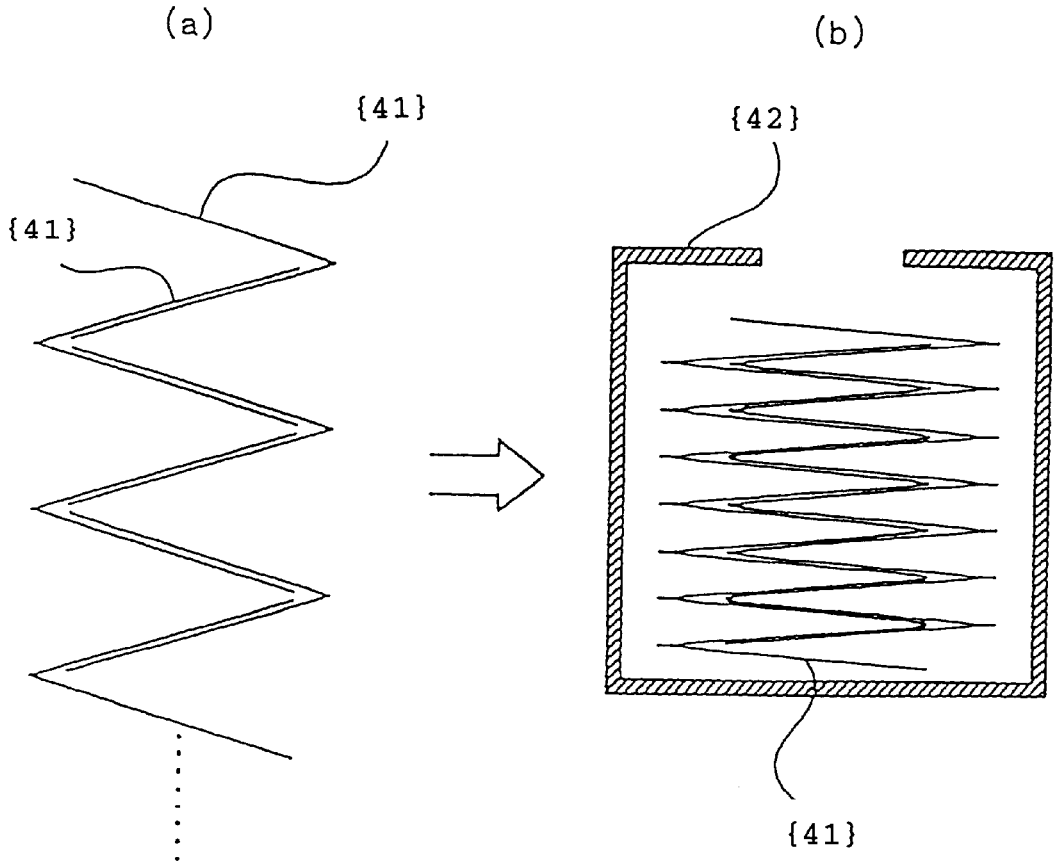
FIG. 4 schematically shows an example of the article for laundry according to the present invention.

The sheetlike article for laundry according to the present invention can be packaged in an appropriate container to give a highly convenient product for laundry. For example, a plural number of sheets of the article for laundry according to the present invention are prepared and each sheet is partly folded. Then these sheets are laminated zigzaggedly and packaged in a container, thus giving a packaged product for laundry which makes it possible to take out the sheets continuously. FIG. 4 shows a product of this type. As FIG. 4(*a*) shows, partly folded sheets {41} are piled up in a zigzag configuration and then packaged in a definite container, for example, a paper box {42} shown in FIG. 4(*b*) to thereby give an article for laundry wherein the sheets can be continuously taken out. In this case, it is preferable that the sheet has an area of at least 9 $cm^2$, still preferably from 40 to 500 $cm^2$. It is also possible to give an article for laundry by rolling up the sheetlike article for laundry of the present invention having a width of 4 cm or more and a length of 30 cm or longer and then packaging the thus obtained roll in a definite container. Products of these types are favorable from the viewpoints of convenience and easiness in arbitrary dispensing. In the case of the roll-type products, furthermore, a container (paperbox, etc.) can be provided with a sheet cutter made of a metal and/or a resin so as to facilitate using. Also, the roll may be perforated in direction of the width at constant intervals so that more inner sheets in a definite size can be artificially or mechanically taken out. Needless to say, the sheet may be graduated to indicate the consumption. It is also possible to conveniently pack the sheetlike article by individually processing a single dose of 5 to 20 g of active detergent components into a sheet and then packaging the thus obtained sheets in a container optionally with arrangement in lines. In this mode, a piece of a sheet remaining after tearing can be packaged in the container again.

The detergent according to the present invention is a sheetlike article which is freed from the leak or flow-out of the contents when it is torn or during using. Accordingly, it can be loaded or employed in various modes which cannot be applied to the conventional powdery or one-pack type detergents. For example, the sheetlike article for laundry can be perforated so as to facilitate tearing. It is also possible to improve the appearance of the article by printing figures or letters thereon. Also, directions and instructions for using can be printed thereon to make consumers attend. Although the process for the production of the composition layer makes it easily possible to form a continuous layer, it is also possible, as a matter of course, to form a discontinuous composition layer.

To further illustrate the present invention in greater detail, the following Examples will be given. However, it is to be understood that the present invention is not restricted thereto.

Test Method 1

Now, test methods employed in Test Examples will be illustrated.

Method I for Measuring Penetration Hardness 1,000 g in total of the components of each detergent composition and a coloring matter (Red No. 106) employed as a marker are fed into a Dalton Universal Mixer (Model 5DM-03-r). After adjusting the temperature to about 25° C., the mixture is kneaded first at a low speed (about 100 rpm) for 1 minute and then at a high speed (about 200 rpm). The b value of the kneaded matter is measured by using a color meter (CR-300) manufactured by Minolta Co., Ltd. and the high-speed kneading is continued until the b value attains to a constant level, thereby giving a uniform detergent composition.

Onto the surface of the detergent composition maintained at 25° C. is pressed an adapter ③ (bottom area: 1 $cm^2$) exclusively for FUDOH RHEO METER (RT-2010J-CW). When the adapter penetrates into the detergent composition by 20 mm at a rate of 30 cm/min, the stress is measured.

Method I for Evaluating the Leak/flow-out of Composition Under Loading (Flow-out Resistance)

A sheetlike detergent is cut all around into a size of 5 cm×5 cm and weighed (weight: $W_i$). Next, a weight of 200 g is loaded on the sheetlike detergent, in such a manner that the weight is loaded all over the surface of the sheetlike detergent. After allowing to stand horizontally at 25° C. under a relative humidity of 60% for 30 minutes, the cut sides are traced with a knife and thus the contents (i.e., the detergent composition) flowing out from the sheet is collected followed by weighing, as weight: $W_a$. The flow-out ratio is expressed in $W_a/W_i$ at % by weight. In this method, it is preferable that the flow-out ratio is 5% or less.

Method I for Evaluating the Flow-out/leak of Composition at Tearing (Flow-out Resistance)

A sheetlike article of 10 cm×20 cm is cut with marketed scissors at the center thereof in a room at 25° C. under a relative humidity of 60%, then fixed the uncut side of 5 mm with a clip. While hanging the sheet with the cut sides downward for 30 minutes, the detergent flowing out/leaking from the sheet is pooled in a plastic tray and weighed.

Method I for Measuring Detergency

Preparation of Artificially Stained Cloth

An artificially stained cloth sample is prepared by soiling a cloth piece with an artificial staining solution of the following composition. The cloth is stained with the artificial staining solution by printing with the use of a gravure roll coater. The staining operation is effected at a gravure roll's cell volume of 58 $cm^3/m^2$ and a coating speed of 1.0 m/min, and drying is performed at a temperature of 100° C. for 1 minute. As the cloth, use is made of a cotton shirt 2003 (manufactured by Tanigashira Shoten).

Composition of Artificial Staining Solution

| | |
|---|---|
| lauric acid | 0.44% by weight |
| myristic acid | 3.09% by weight |
| pentadecanoic acid | 2.31% by weight |
| palmitic acid | 6.18% by weight |
| heptadecanoic acid | 0.44% by weight |
| stearic acid | 1.57% by weight |
| oleic acid | 7.75% by weight |
| triolein | 13.06% by weight |
| n-hexadecyl palmitate | 2.18% by weight |
| squalene | 6.53% by weight |
| albumen lecithin liquid crystal | 1.94% by weight |
| Kanuma Aka - tsuchi (red soil) | 8.11% by weight |
| carbon black | 0.01% by weight |
| tap water | the balance. |

Washing Conditions and Evaluation Method

Five pieces of the artificially stained cloth of 10 cm×10 cm prepared above were introduced into 1 liter of an aqueous solution of the detergent to be evaluated and washed in Terg -○-tometer at 100 rpm under the following conditions.

Washing Conditions

| | |
|---|---|
| washing time | 10 min |
| detergent concentration | 0.05% |
| hardness of water | 4° DH |
| water temperature | 20° C. |
| rinsing | 5 min in tap water. |

The detergency is evaluated by measuring the reflectance at 550 nm of the initial (i.e., unstained) cloth and those of the stained cloth before and after washing by using a recording color meter (manufactured by Shimadzu Corp.) and then calculating the detergency ratio (%) in accordance with the following formula. The average of 5 cloth pieces is expressed as the detergency.

$$\text{Detergency (\%)} = \frac{(\text{reflectance after washing}) - (\text{reflectance before washing})}{(\text{reflectance of initial cloth}) - (\text{reflectance before washing})} \times 100.$$

TEST EXAMPLE I-1

The components in total of 1,000 g listed in Table 1 were fed at the ratio as given in Table 1 into a Dalton Universal Mixer (Model 5DM-03-r) . After adjusting the temperature to about 25° C., the mixture was kneaded first at a low speed (about 100 rpm) for 1 minute and then at a high speed (about 200 rpm) until the powdery mixture became doughy, thereby giving a uniform detergent composition.

Next, this doughy detergent composition was processed into a thin layer of 2 mm in thickness by using a noodle making machine "titania (registered trademark)" (manufactured by Industrial Prodotti Stampati TORINO). Subsequently, this thin layer was cut into pieces of 50×100 mm in size. These layer slices showed an average weight of 15 g and an average area density of 0.3 g/cm$^2$.

Next, fiber prepared in accordance with Example 1 of JP-A 8-3848 was processed into a nonwoven fabric of 20 g/m$^2$ in Metsuke (weight per unit are) by the spun bond method and "Hi-selon (a water-soluble film)" manufactued by Nippon Synthetic Chemical Industry, Co., Ltd. was laminated thereonto. The thin layer sheet cut above was sandwiched between the thus obtained two laminate sheets, in such a manner that the nonwoven fabric served as the outermost layers. Next, the obtained composite sheet was heat-sealed all around with a FUJI IMPULSE AUTO SEALER (FA-600-5) to give a sheetlike detergent. Then the obtained sheetlike detergent was evaluated in the flow-out amounts under loading and at tearing by the methods described above. Table 1 shows the results.

Further, the sheetlike detergent was divided equally into three parts by perforating and torn with hands. As a result, it could be easily torn with little leak or flow-out of the detergent. Also, the detergent scarcely adhered to hands. The sheetlike detergent was dissolved in ion-exchanged water to give a definite concentration and the detergency thereof was evaluated by the above method. As a result, it achieved a detergency ratio of 58%. The penetration hardness of the doughy detergent composition measured by the above method was 2.63 kg/cm$^2$.

TEST EXAMPLE I-2

By using the components listed in Table 1 at the ratio given in Table 1, a doughy detergent composition was prepared in the same manner as the one of Test Example I-1.

This doughy detergent composition was molded in molds of 70 mm in length, 70 mm in width and 0.7 mm in depth to give thin layer slices as large as the mold. These slices showed an average weight of 5.1 g and an average area density of 0.10 g/cm$^2$.

Next, fiber prepared in accordance with Example 1 of JP-A 8-3848 was processed into a nonwoven fabric of 20 g/m$^2$ in Metsuke by the spun bond method. The above thin layer sheet was sandwiched between the thus obtained nonwoven fabrics to give a sheetlike detergent. Table 1 shows the flow-out amounts under loading and at tearing and the detergency of the obtained sheetlike detergent. It could be easily torn with hands with little leak or flow-out of the detergent. Also, the detergent scarcely adhered to hands. Table 1 also shows the penetration hardness of this detergent composition measured by the above method.

TEST EXAMPLE I-3

The components in total of 300 g listed in Table 1 at the ratio given in Table 1 were fed into a BENCH KNEADER (PNV-1) manufactured by Irie Shokai K.K. After heating to 30° C., the powdery mixture was stirred at the scale 4 until a doughy mixture was obtained, thus giving a uniform doughy detergent composition.

Next, two water-soluble films "Hi-selon" manufactured by the Nippon Synthetic Chemical Industry Co., Ltd. were inserted between to stainless rollers (diameter: 50 mm) manufactured by Sanriki Seisakusyo capable of rotating in the opposite directions to each other. While manually operating the rollers, the above-mentioned dough was sandwiched between the water-soluble films and the obtained composite material was cut into pieces of 10 cm×10 cm. Next, the obtained sheet was heat-sealed all around with a FUJI IMPULSE AUTO SEALER (FA-600-5) to give a sheetlike detergent. The obtained sheetlike detergent had a detergent composition layer of 4 mm in thickness and weighed 60 g on average. The average area density thereof was 0.6 g/cm$^2$. Table 1 shows the flow-out amounts under loading and at tearing and the detergency of the sheetlike detergent. Further, the sheetlike detergent was divided equally into three parts by perforating and torn with hands. As a result, it could be easily torn with little leak or flow-out of the detergent. Also, the detergent scarcely adhered to hands. Table 1 also shows the penetration hardness of the sheetlike detergent measured by the above method.

TEST EXAMPLE I-4

The components listed in Table 1 at the ratio given in Table 1 were fed into a KRC Kneader (Model S1) manufactured by Kurimoto, Ltd. provided with a slit of 1.2×50 mm and kneaded therein at room temperature at 100 rpm to give a thin layer of a doughy detergent composition of 1.2 mm in thickness.

Next, fiber prepared in accordance with Test Example I-1 of JP-A 1-229805 was processed into a nonwoven fabric of 40 or 20 g/m$^2$ in Metsuke by the spun bond method. The above thin layer was sandwiched between these nonwoven fabrics and passed through the noodle making machine roller employed in Test Example I-1 to give a thin layer of 3 mm in thickness wherein the water-soluble nonwoven fabrics were impregnated with the detergent composition. Then the thin layer was cut into pieces of 50×100 mm in size. These sheets showed an average weight of 18 g and an average area density of 0.36 g/cm$^2$.

Next, the thin layer piece of 3 mm in thickness obtained by impregnating the nonwoven fabric with the detergent composition was sandwiched between two laminate sheets prepared by laminating a water-soluble nonwoven fabric prepared in accordance with Test Example I-2 of JP-A 8-3848 and having a Metsuke (weight per unit area) of 20 g/m$^2$ and a water-soluble film "Hi-selon" manufactured by The Nippon Synthetic Chemical Industry, Co., Ltd. in such a manner that the nonwoven fabric served as the outermost layers. Next, the obtained composite sheet was heat-sealed all around with a FUJI IMPULSE AUTO SEALER (FA-600-5) to give a sheetlike detergent. Table 1 shows the flow-out amounts under loading and at tearing and the detergency of the thus obtained sheetlike detergent. Further, the sheetlike detergent was divided equally into three parts by perforating and torn with hands. As a result, it could be easily torn with little leak or flow-out of the detergent. Also, the detergent scarcely adhered to hands. Table 1 also shows the penetration hardness of the detergent composition measured by the above method.

TEST EXAMPLES I-5 to I-9

Each doughy detergent composition was prepared by the same method as the method of Test Example I-1 with the use of the components as listed in Table 1 or 2 at the ratio given therein.

Next, a sheetlike detergent was obtained in the same manner as the manner of Test Example I-1. As the water-soluble nonwoven fabric, use was made of the fabric having a Metsuke (weight per unit area) of 25 g/m$^2$. The thin layers of the detergent composition in each sheetlike detergent showed an average weight of 13 to 20 g and an average area density of 0.26 to 0.4 g/cm$^2$. Tables 1 and 2 show the flow-out amounts under loading and at tearing and the detergency of each sheetlike detergent thus obtained. Further, the sheetlike detergent was divided equally into three parts by perforating and torn with hands. As a result, it could be easily torn with little leak or flow-out of the detergent. Also, the detergent scarcely adhered to hands. Tables 1 and 2 also show the penetration hardness of the detergent composition of each Test Example measured by the above method.

TEST EXAMPLES I-10 to I-12

Each detergent composition was prepared by the same method as the method of Test Example I-1 with the use of the components as listed in Table 2 at the ratio given therein.

The detergent composition of Test Example I-10 could be hardly processed into such a thin layer as in the above Test Examples due to its high fluidity. Thus, the detergent composition was packed in 15 g portions into bags of 5 cm in inner diameter and 10 cm in depth made of the same laminate sheet as the sheet used in Test Example I-1.

In Test Examples I-11 and I-12, thin layer pieces were prepared in the same manner as the manner of Test Example I-2 and then processed into sheetlike detergents with the use of the laminate sheet employed in Test Example I-1 in the same manner as used therein. Table 2 shows the flow-out amounts at tearing and the detergency of each sheetlike detergent thus obtained. Further, these sheetlike detergents were divided equally into three parts by perforating and torn with hands. As a result, the leak or flow-out of the detergent was observed in each case. Also, the detergent adhered to hands.

Table 2 also shows the penetration hardness of the detergent composition of each Test Example measured by the above method.

TABLE 1

| Component | Component No. | Test Example no. I-1 | I-2 | I-3 | I-4 | I-5 | I-6 |
|---|---|---|---|---|---|---|---|
| Detergent composition (wt. %) | | | | | | | |
| nonionic surfactant | *1 | 12 | | | | | |
| nonionic surfactant | *2 | 12 | | | | | |
| nonionic surfactant | *3 | | 25 | | | 20 | 25 |
| nonionic surfactant | *4 | | | 17 | | 10 | |
| nonionic surfactant | *5 | | | | 20 | | |
| anionic surfactant | *6 | | 3 | 2 | 2 | 4 | |
| anionic surfactant | *7 | | | | 2 | | 2 |
| anionic surfactant | *8 | | | 8 | | | |
| anionic surfactant | *9 | | | 2 | | | |
| anionic surfactant | *10 | | 2 | 1 | 2 | | |
| carbonate | *11 | 30 | 3 | 25 | 10 | 25 | 30 |

TABLE 1-continued

| Component | Component No. | Test Example no. I-1 | I-2 | I-3 | I-4 | I-5 | I-6 |
|---|---|---|---|---|---|---|---|
| Glauber salt | | | | | | | |
| crystalline silicate | *12 | | 32 | 2 | 20 | | |
| crystalline aluminosilicate | *13 | 30 | 20 | 30 | 35 | 20 | 25 |
| amorphous aluminosilicate | *14 | 4 | 3 | | | 8 | 5 |
| organic chelating agent | *15 | 2 | | | | | |
| organic chelating agent | *16 | | | 2 | | | |
| polycarboxylic acid polymer | *17 | 2 | | | | 2 | |
| polycarboxylic acid polymer | *18 | | 4 | 3 | | 2 | 4 |
| polycarboxylic acid polymer | *19 | | | | 2 | | |
| dissolution aid | *20 | | | 2 | | | 2 |
| dissolution aid | *21 | 2 | | | 2 | 2 | |
| organic builder | *22 | 2 | 2 | 2 | 1 | 1 | 1 |
| organic builder | *23 | | | | | 4 | |
| bleaching component | *24 | | | | | | |
| bleaching component | *25 | | | | | | |
| common component | *26 | 4 | 6 | 4 | 4 | 2 | 6 |
| Content of liquid active components, at ordinary temperature, in total active components | 100% | 83% | 57% | 77% | 88% | 93% | |
| Content of liquid organic matters in total organic compounds | 29% | 40% | 60% | 39% | 24% | 38% | |
| Content of inorganic matters in whole composition | 66% | 58% | 57% | 67% | 55% | 60% | |
| Evaluation | | | | | | | |
| penetration hardness (kg/cm$^2$) | 2.63 | 0.47 | 2.53 | 5.04 | 0.17 | 0.17 | |
| flow-out resistance | | | | | | | |
| under loading (g) | 0.4 | 0.8 | 0.2 | 0.3 | 0.5 | 0.6 | |
| at tearing (g) | 0.01 | 0.05 | 0.01 | 0.1 | 0.2 | 0.1 | |
| detergency (%) | 58 | 66 | 61 | 64 | 59 | 61 | |

TABLE 2

| Component | | Component no. | Test Example no. I-7 | I-8 | I-9 | I-10 | I-11 | I-12 |
|---|---|---|---|---|---|---|---|---|
| Deter-gent comp-osi-tion (wt. %) | nonionic surfactant | *1 | | 2 | | 35 | 20 | |
| | nonionic surfactant | *2 | | | 13 | | | |
| | nonionic surfactant | *3 | | | | | | 20 |
| | nonionic surfactant | *4 | 10 | 20 | | | | |
| | nonionic surfactant | *5 | | | 3 | | 5 | |
| | anionic surfactant | *6 | 20 | 1 | | | | |
| | anionic surfactant | *7 | 5 | | | | | |
| | anionic surfactant | *8 | | | 5 | | | |
| | anionic surfactant | *9 | | | 2 | | | |
| | anionic surfactant | *10 | | | 1 | | | |
| | carbonate | *11 | 25 | 25 | 25 | 15 | | 30 |
| | Glauber salt | | | | | | | |
| | crystalline silicate | *12 | | 3 | 2 | 15 | | |
| | crystalline aluminosilicate | *13 | 25 | 25 | 20 | 25 | 45 | |
| | amorphous aluminosilicate | *14 | | 4 | | | | |
| | organic chelating agent | *15 | | 2 | 2 | | | |
| | organic chelating agent | *16 | | | | | 5 | |
| | polycarboxylic acid polymer | *17 | | | 2 | | 5 | |
| | polycarboxylic acid polymer | *18 | 5 | 3 | | 4 | | |
| | polycarboxylic acid polymer | *19 | | | | | | |
| | dissolution aid | *20 | 3 | | | | 4 | 2 |
| | dissolution aid | *21 | | | 5 | | | |
| | organic builder | *22 | 1 | 1 | 2 | 1 | 2 | 2 |
| | organic builder | *23 | | | | | | 2 |
| | bleaching component | *24 | | 10 | | | | |
| | bleaching component | *25 | | | 12 | | | |
| | common component | *26 | 6 | 4 | 6 | 5 | 5 | 4 |
| Content of liquid active components, at ordinary temperature, in total active components | | | 29% | 96% | 67% | 100% | 100% | 100% |
| Content of liquid organic matters in total organic compounds | | | 80% | 37% | 67% | 22% | 46% | 27% |

TABLE 2-continued

| Component | | | Component no. | Test Example no. I-7 | I-8 | I-9 | I-10 | I-11 | I-12 |
|---|---|---|---|---|---|---|---|---|---|
| Content of inorganic matters in whole composition | | | | 50% | 65% | 52% | 55% | 54% | 70% |
| Evaluation | Penetration hardness ($kg/cm^2$) | | | 2.50 | 0.18 | 5.88 | 0.00 | 0.01 | 0.01 |
| | flow-out resistance | under loading (g) | | 1.5 | 0.3 | 0.7 | 18.0 | 12.0 | 11.0 |
| | | at tearing (g) | | 0 | 0.1 | 0.3 | 1.3 | 1 | 0.8 |
| | Detergency (%) | | | 58 | 59 | 61 | 49 | 32 | 41 |

(Note)
*1: 6 mols on average of ethylene oxide adduct to lauryl alcohol.
*2: 6.5 mols on average of ethylene oxide adduct to $C_{12-13}$ alcohols manufactured by Mitsubishi Chemical Corp. (Nonidet S-6.5).
*3: 7 mols on average of ethylene oxide adduct to $C_{12-14}$ secondary alcohols manufactured by Nippon Shokubai Co., Ltd. (Softanol 70).
*4: 3 mols on average of ethylene oxide/2 mols on average of propylene oxide/3 mols on average of ethylene oxide adduct at block arrangement of $C_{12}$ alcohol/$C_{14}$ alcohol mixture (wt. ratio 75/25).
*5: 6 mols on average of ethylene oxide adduct to coconut oil fatty acid methyl ester (Exceparl MC) manufactured by Kao Corp.
*6: Mixture of sodium salts and potassium salts of linear alkyl($C_{10-13}$) benzenesulfonic acid at weight ratio of 1/1.
*7: Mixture of alkylsulfate sodium salts and diethanolamine (coconut oil fatty acid composition) at weight ratio of 1/1.
*8: α-sulfofatty acid methyl ester sodium salts having 14 to 16 carbon atoms in fatty acid residue.
*9: Sodium α-olefinsulfonates having 14 to 16 carbon atoms.
*10: Sodium salts of beef tallow fatty acids.
*11: Mixture of sodium carbonate and potassium carbonate at weight ratio of 7/3.
*12: "SKS-6" manufactured by Hoechst.
*13: Synthetic zeolite "Toyobuilder" manufactured by Tosoh Corp.
*14: "Tixolex 25" manufactured by Rhodia.
*15: Trisodium citrate.
*16: Sodium ethylenediaminetetraacetate.
*17: Sodium polyacrylate "Sokalan PA40" manufactured by BASF.
*18: Sodium salt of acrylic acid/maleic acid copolymer "Sokalan CP5" manufactured by BASF.
*19: Sodium polyglyoximate represented by the formula (X) (Mw: ca. 9,000).

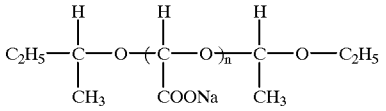

(X)

*20: Sodium p-toluenesulfonate.
*21: Bentonite (reagent).
*22: Polyethylene glycol (Mw: ca. 6,000).
*23: Vinylpyrrolidone-containing polymer "GAFQUAT 734" manufactured by ISP (Japan) Ltd.
*24: Bleaching component comprising bleaching activator represented by the formula (XI) and sodium percarbonate at weight ratio of 1/4.

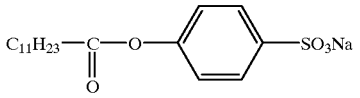

(XI)

*25: Bleaching component comprising "tetraacetyl-ethylenediamine" manufactured by Hoechst and sodium percarbonate at weight ratio of 1/4.
*26: Mixture [comprising 1% by weight of enzyme mixture prepared by blending "API-21H" (manufactured by Showa Denko K.K.) as protease, "Lipolase 100T" (manufactured by Novo Nordisk) as lipase, "Cellzyme 0.1T" (manufactured by Novo Nordisk) as cellulase and "Termamyl 60T" (manufactured by Novo Nordisk) as amylase at weight ratio of 2/1/1/1]; 0.5% by weight of fluorescent dye [prepared by mixing"Whitex SA" manufactured by Sumitomo Chemical Co., Ltd. and "Ciba-Geigy Ltd. at weight ratio of 1/1]; 0.25% by weight of defoaming/foam inhibiting agent [aminoalkyl-modified silicone oil]; 0.25 % by weight of the perfumes listed in the following Table 3 and Glauber salt in the balance amount to give 100% by weight.

TABLE 3

| | Content |
|---|---|
| Linalool | 5 |
| Geraniol | 5 |
| Citronellol | 10 |
| Phenylethyl alcohol | 10 |
| Geranyl acetate | 1 |
| Benzyl acetate | 2 |
| Phenyethyl acetate | 1 |

TABLE 3-continued

| | Content |
|---|---|
| Citral | 1 |
| Limonene | 2 |
| Terpinolene | 3 |
| 4-(4-hydroxy-4-methylpentyl)-3-cyclohexene-1-carboxyaldehyde | 3 |
| α-hexylcinnamic aldehyde | 5 |
| α-isomethylionone | 7 |

TABLE 3-continued

| | Content |
|---|---|
| 3,4-methylenedioxybenzaldehyde | 4 |
| 1,3,4,6,7,8-hexahydro-4,6,6,7,8,8-hexa-methylcyclopenta-γ-2-benzopyrane | 12 |
| Synthetic sandal | 7 |
| Trichloromethylphenylcarbinol acetate | 1 |
| 1,2-benzopyrone | 2 |
| ethyl-β-phenyl acrylate | 5 |
| acetyl cedorine | 5 |
| 1-methyl-4-isopropyl-1-cyclohexen-8-ol | 9 |

Result I

As the above data clearly indicate, the sheetlike detergents of Test Examples I-1 to I-9, each composed of water-soluble substrates and a doughy detergent composition having a specific penetration hardness sandwiched between the substrate, showed little scattering of the powder owing to the doughy state thereof. Because of having a specific hardness, moreover, these articles showed little leak of the contents in using or at tearing and facilitated arbitrary dispensing. In addition, these sheetlike detergents established excellent detergency thanks to the nonionic surfactants effective in removing oily stains and alkaline agents and sequestering agents, i.e., the fundamental components of detergents, contained therein.

In contrast, the products of Test Examples I-10 to I-12 were poor in penetration hardness. In these examples, namely, the detergent compositions were soft and highly fluid and therefore any sheetlike article could be hardly obtained. Even though a sheetlike article could be obtained, there arose the leak of the detergent composition, which made the use thereof inconvenient. In Test Examples I-11 and I-12, the detergent compositions could achieve only insufficient detergency because of the absence of either an alkaline agent or a sequestering agent.

Test Method II

Now, the test methods employed in Examples will be illustrated. In Test Examples II-1 to II-6, use was made of the method of Test Example II.

Method II for Evaluating the Flow-out/leak of Composition at Tearing

Measurement was effected by the same method as the above-mentioned method I for evaluating the flow-out/leak of composition at tearing.

TEST EXAMPLE II-1

<Sheetlike Detergent for Clothes>

25 g of dodecyldimethylamine oxide removed moisture preliminarily in a microwave oven; 10 g of "Nonidet R-7" manufactured by Mitsubishi Chemical Corp. [polyoxyethylene (7) alkyl ($C_{12-15}$) ether] sulfate (sodium salt); 5 g of "Softanol EP7045" manufactured by Nippon Shokubai Co., Ltd. [$C_{12-14}$ secondary alcohol polyoxyethylene (7) polyoxypropylene (4.5) glycol]; 40 g of zeolite A manufactured by Tosoh Corp.; 4 g of acrylic acid/maleic acid copolymer potassium salt (Mw: 60,00); 8 g of soda ash; 2.5 g of polypropylene glycol (Mw: 1,000); 3 g of "Tixolex 25" manufactured by Kofran Chemical; 0.2 g of d-limonene; 0.9 g of "API-21" manufactured by Showa Denko K.K. as a protease; 0.9 g of "Celluzyme 1.0T" manufactured by Novo Nordisk Industry as a cellulose; 0.5 g of "Termamyl 6.0T" manufactured by Novo Nordisk Industry as an amylase; 0.2 g of "Lipolase 100T" manufactured by Novo Nordisk Industry as a lipase and 0.2 g of a fluorescent dye "Chinopal CBS-X" manufactured by Ciba-Geigy were mixed with hands to give a dough.

Next, two laminate sheets (10 cm×20 cm), which had been prepared by laminating a nowoven fabric having a Metsuke (weight per unit are) of 20 g/m$^2$ formed in accordance with Example 2 of JP-A 8-3848 onto by a water-soluble film "Hi-selon" manufactured by The Nippon Synthetic Chemical Industry, Co., Ltd., were inserted between two stainless rollers having diameters of 50 mm. The rollers were manufactured by Sanriki Seisakusyo capable of rotating in the opposite directions to each other so that the nonwoven fabric served as the outermost layers. While manually operating the rollers, the above-mentioned dough was sandwiched between the water-soluble films and the obtained dough of 7 g was inserted between the two laminate sheets to give a sheetlike detergent for clothes. This procedure was repeated 50 times thus giving 50 sheets of the sheetlike detergents containing 7 g of the detergent per sheet of 10 cm×20 cm in size. These sheets had an average area density of 0.047 g/cm$^2$ and an average thickness of 1.2 mm. Next, all of these sheets were folded in two, overlapped together in a meshed arrangement as shown in FIG. 3, and then packaged in a paper box of 12 cm in length, 13 cm in width and 9 cm in depth. At the upper face of the box, a rectangular hole of 6 cm×4.5 cm in size was formed and a sheet of the detergent article was taken out from the box. As a result, the next sheet was partly pulled out of the box. This procedure could be repeated 47 times. It was thus confirmed that these sheets could be easily taken out without inserting hands or fingers into the box. Also, these sheets could be torn with hands while showing little leak or flow-out of the detergent. It scarcely adhered to hands. When measured by the above-mentioned method, 0.00 g of the detergent leaked or flew out.

TEST EXAMPLE II-2

<Sheetlike Detergent for Clothes>

A mixture of the following composition was obtained. Namely, the composition is that 5% by weight of "Softanol 70" manufactured by Nippon Shokubai [polyoxyethylene(7) alkyl($C_{12-14}$) ether]; 5% by weight of "Nonidet R-7" [polyoxyethylene(7) alkyl($C_{12-15}$) ether]; 0.4% by weight of polyoxyethylene(6) alkyl($C_{12}/C_{14}/C_{16}$=70/25/5) ether; 3.6% by weight of coconut oil fatty acid sodium salts; 10% by weight of LAS-Na obtained by neutralizing alkylbenzenesufonic acid (Alken L) manufactured by Nisseki Senzai K.K. with the use of 48% NaOH and drying; 2% by weight of AS-Na (manufactured by Mitsubishi Chemical Corp. "Alkyl (Dobanol 25) sulfate" ($C_{12-15}$ sulfates)]; 15.6% by weight of zeolite A manufactured by Tosoh Corp.; 3.6% by weight of a porous silica compound "Tixolex 25" manufactured by Kofran Chemical; 6% by weight of crystalline silicate ("SKS-6" manufactured by Hoechst); 4.4% by weight of sodium silicate No. 1; 8% by weight of soda ash manufactured by Tosoh Corp.; 0.8% by weight of acrylic acid/maleic acid copolymer (Mw: 60,000) Na salt; 2.4% by weight of sodium polyacrylate (Mw: 20,000); 1.2% by weight of polyacetal carboxylate sodium salt (Mw: 20,000); 22.4% by weight of polyethylene glycol (Mw: 60,000); 4.6% by weight of potassium carbonate; 1.4% by weight of sodium sulfate; 1.6% by weight of an enzyme mixture comprising "API-21" manufactured by Showa Denko K.K. and "Celluzyme 1.0T" manufactured by Novo Nordisk Industry at mixed ratio of 1:1; 0.4% by weight of "Chinopal CBS-X" manufactured by Ciba-Geigy and the balance of water.

Next, two laminate sheets of 15 cm in width and 25 m in length, which had been prepared by laminating a nonwoven fabric having a Metsuke of 20 g/m$^2$ formed in accordance with Example 3 of JP-A8-127919onto a water-soluble film"Hi-selon" manufactured by The Nippon Synthetic Chemical Industry, Co., Ltd., were inserted between the same two stainless rollers having diameter of 50 mm (,which are same rollers of Test Example II-1,) as same manner in Test Example II-1. While rotating the rollers at a rate of 1 m/minutes, the mixture prepared above was sandwiched between the water-soluble films at a constant rate to give a sheetlike detergent for clothes of 10 m in length. This sheet had an average area density of 0.053 g/cm$^2$ and an average thickness of 1.3 mm. Next, 20 m of the sheet was wound around a cardboard roll of 11 cm in width and 2.5 cm in diameter and put into a box equipped with a cutter. Thus, the sheet could be easily torn at an arbitrary length with the use of the metallic cutter given at the upper part of the box with little leak or flow-out of the detergent. Also, it scarcely adhered to hands. When measured by the above-mentioned method, 0.11 g of the detergent leaked or flew out.

TEST EXAMPLE II-3

<Sheetlike Bleaching Agent>

Two sheets of 15 cm in width and 25 m in length of a nonwoven fabric having a Metsuke of 10 g/m$^2$ formed in accordance with Example 1 of JP-B 3-25539 were inserted between two stainless rollers having diameter of 50 mm capable of rotating in opposite directions to each other at a speed of 1 m/minute. While rotating the rollers, a composition comprising 70% by weight of sodium percarbonate, 5% by weight of tetraacetylethylenediamine employed as a bleaching activator, 5% by weight of sodium coconut oil alkanoyloxybenzenesulfonate, 2% by weight of fumaric acid employed as a stabilizer, 10% by weight of polyethylene glycol (average Mw: 2,000) and 8% by weight of sodium carbonate was supplied between the two nowoven fabric sheets at a constant rate to give a sheetlike bleaching agent for clothes of 10 m in length. This sheet had an average area density of 0.050 g/cm$^2$ and an average thickness of 1.6 mm. Next, 20 m of the sheet was wound around a cardboard roll of 11 cm in width and 2.5 cm in diameter and put into a box equipped with a cutter. Thus, the sheet could be easily torn at an arbitrary length with the metallic cutter without any leak or flow-out of the bleaching agent. Also, it scarcely adhered to hands. When measured by the above-mentioned method, 0.07 g of the detergent leaked or flew out.

TEST EXAMPLE II-4

<Sheetlike Softener for Clothes>

A composition was prepared by mixing 42% by weight of a softener base represented by the following formula, 35% by weight of dihdyrogenated beeftallow alkyldimethylammonium chloride, 11% by weight of glycerol, 11% by weight of propylene glycol and 1% by weight of d-limonene.

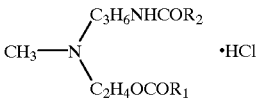

Next, two laminate sheets of 10 cm×20 cm were prepared by laminating a nonwoven fabric having a Metsuke of 25 g/m$^2$ formed in accordance with Example 2 of JP-B 3-25539 onto a water-soluble film "Hi-selon" manufactured by The Nippon Synthetic Chemical Industry, Co., Ltd. Then one of these laminate sheets was placed on a steel plate of 13 cm×22 cm and 7 g of the above composition was uniformly spread out thereon. Next, another laminate sheet was placed thereon followed by covering with another steel plate of 13 cm×22 cm. Subsequently, a load of 400 kgf was applied in 15 points of the sheet with the use of a press machine manufactured by AIKO Engineering to give a sheetlike softener. This procedure was repeated 50 times thus giving 50 sheets of the sheetlike softener containing 7 g of the softening agent per sheet of 10 cm×20 cm. These sheets had an average area density of 0.022 g/cm$^2$ and an average thickness of 0.9 mm. Next, all of these sheets were folded in two, overlapped together in a meshed arrangement as shown in FIG. 3, and then packaged in a paper box of 12 cm in length, 13 cm in width and 9 cm in depth. At the upper face of the box, a rectangular hole of 6 cm×4.5 cm was formed. It was thus confirmed that these sheets could be continuously taken out from the hole. Also, these sheets could be torn with hands while showing little leak or flow-out of the detergent. It scarcely adhered to hands. When measured by the above-mentioned method, 0.00 g of the detergent leaked or flew out.

TEST EXAMPLE II-5

<Sheetlike Detergent for Clothes>

To 30 g of the dough-like composition prepared in Test Example II-1 was added 5 g of zeolite A manufactured by Tosoh Corp. Next, the obtained mixture was treated with a noodle making machine "titania (registered trademark)" manufactured by Industria Prodotti Stampati TORINO to give thin layers having a thickness less than 1 mm. Subsequently, these thin layers were coated uniformly in both of the surfaces with 0.8 g of a fiber (3 mm in length) prepared in accordance with Example 2 of JP-A 8-3848 to give two sheets of 17 cm×8.5 cm of detergent for clothes. This procedure was repeated 20 times thus giving 40 sheets of the sheetlike detergent. These sheets had an average area density of 0.13 g/cm$^2$ and an average thickness of 1.0 mm. Next, all of these sheets were folded in two, overlapped together in a meshed arrangement, and then packaged in a paper box of 10 cm in length, 10 cm in width and 10 cm in depth. At the upper face of the box, a rectangular hole (6 cm×4.5 cm) was formed and one sheet was taken out therefrom. As a result, the next sheet was partly pulled out of the box. This procedure could be repeated 15 times. Also, these sheets could be torn with hands without showing any leak or flow-out of the detergent. It scarcely adhered to hands. When the sheet was cut with scissors, it was found out by the above-mentioned method that 0.01 g of the detergent leaked or flew out.

TEST EXAMPLE II-6

<Rolled Sheetlike Detergent for Clothes>

A liquid composition was obtained by mixing 600 g of "Nonidet R-7" manufactured by Mitsubishi Chemical Corp. [polyoxyethylene (7) alkyl ($C_{12-15}$) ether], 300 g of "Softanol EP7045" manufactured by Nippon Shokubai Co., Ltd. [$C_{12-14}$ secondary alcohol polyoxyethylene(7) polyoxypropylene (4.5) glycol], 100 g of polypropylene glycol (Mw: 1,000) and 200 g of sulfate of "Nonidet R-7" manufactured by Mitsubishi Chemical Corp. [polyoxyethylene (7) alkyl ($C_{12-15}$) ether].

In this liquid composition was immersed a sheet of 15 cm in width and 5 m in length of a nonwoven fabric having a Metsuke of 15 g/m$^2$ formed in accordance with Example 3 of JP-A 8-127919 for 5 minutes. After thus sufficiently moistening, the nonwoven fabric was inserted between the same two stainless rollers having diameter of 50 mm (as those employed in Test Example II-1) followed by the supply at a constant rate of a powdery composition comprising 20% by weight of polyethylene glycol (Mw: 6,000), 2% by weight of acrylic acid/maleic acid copolymer (Mw: 60,000) potassium salt, 20% by weight of soda ash, 40% by weight of "Tixolex 25" manufactured by Kofran Chemical, 1% by weight of d-limonene, 0.5% by weight of "API-21" manufactured by Showa Denko K.K., 0.5% by weight of "Celluzyme 1.0T" manufactured by Novo Industry, 0.4% by weight of "Chinopal CBS-X" manufactured by Ciba-Geigy and the balance of zeolite A manufactured by Tosoh Corp. prior to the passage of the rollers. Next, the rollers were rotated in opposite directions to each other at a rate of 1 m/minutes to give a sheetlike detergent coated with the powder. This sheets had an average area density of 0.083 g/cm$^2$ and an average thickness of 0.7 mm. Next, the sheet of 5 m in length was perforated at intervals of 10 cm in the width direction and rolled so as to give a hollow core of 2.5 cm in inner diameter. Then it was packaged in a cylindrical container of 15 cm in diameter and 20 cm in depth and covered with a lid having a crosswise slit cut in the upper face. When the sheet was taken out from the slit, it was cut at the perforated part and, subsequently, the next sheet was partly pulled out of the container. This procedure could be repeated 12 times continuously. When the sheet was torn at the perforated part, it showed little leak or flow-out of the detergent and did not adhere to hands. When the sheet was cut with scissors, it was found out by the above-mentioned method that 0.10 g of the detergent leaked or flew out.

Results

As these results clearly show, the sheetlike articles for laundry of Test Examples II-1 to II-6, each having a detergent, etc. inserted between water-soluble sheets, showed little scattering of the contents during using or at tearing and facilitated arbitrary dispensing. Because of being in the form of a sheet and freed from the leak of the contents (powders, etc.), such an article can be folded zigzaggedly and packaged in a container. Alternatively, it can be rolled up and then packaged in a container. These characteristics clearly contribute to the excellent handling properties of the articles.

What is claimed is:

1. An article sheet for laundry comprising a thin layer containing a detergent composition for clothes, and a means for supporting the thin layer, wherein said means for supporting the thin layer is water soluble, the thin layer having been made of a doughy non-phosphate detergent composition containing at least one nonionic surfactant, at least one alkaline agent, at least one sequestering agent, at least one selected from the group consisting of anionic surfactants and amorphous aluminosilicate and 5 percent by weight or less of moisture, the doughy composition having a penetration hardness at 25° C. of 0.1 to 10 kg/cm$^2$, and said means having been arranged on both surfaces of the thin layer, wherein the sheet has an area density of 0.02 to 0.5 g/cm$^2$.

2. The sheet as claimed in claim 1, wherein the thin layer has a thickness of 0.1 to 5 mm.

3. The sheet as claimed in claim 1, wherein the anionic surfactant is selected from the group consisting of a straight alkyl benzene sulfonate having 12 to 14 carbon atoms in the alkyl and an alkyl sulfate having 12 to 18 carbon atoms in the alkyl.

4. An article sheet for laundry comprising a thin layer containing a detergent composition for clothes, and a means for supporting the thin layer, the thin layer having been made of a doughy non-phosphate detergent composition containing at least one nonionic surfactant, at least one alkaline agent, at least one sequestering agent and polyethylene glycol, the doughy composition having a penetration hardness at 25° C. of 0.1 to 10 kg/cm2, a moisture content of 5 wt % or less, and said means having been arranged on both surfaces of the thin layer, wherein the sheet has an area density of 0.02 to 0.5 g/cm$^2$.

5. The sheet as claimed in claim 4, wherein the doughy composition contains at least one selected from the group consisting of anionic surfactants and amorphous aluminosilicate.

6. The sheet as claimed in claim 4, wherein the thin layer has a thickness of 0.1 to 5 mm.

7. The sheet as claimed in claim 4, wherein the polyethylene glycol works as an organic builder.

* * * * *